US006519826B1

(12) United States Patent
Ortlieb

(10) Patent No.: US 6,519,826 B1
(45) Date of Patent: Feb. 18, 2003

(54) METHOD FOR THE PRODUCTION OF A WATERPROOF AND GASPROOF ZIP FASTENER

(76) Inventor: Hartmut Ortlieb, Rainstrasse 6, D-91560 Heilsbronn (DE)

( * ) Notice: Subject to any disclaimer, the term of this patent is extended or adjusted under 35 U.S.C. 154(b) by 0 days.

(21) Appl. No.: 09/297,494

(22) PCT Filed: Oct. 28, 1997

(86) PCT No.: PCT/DE97/02497

§ 371 (c)(1),
(2), (4) Date: Jun. 21, 1999

(87) PCT Pub. No.: WO98/18359

PCT Pub. Date: May 7, 1998

(30) Foreign Application Priority Data

Oct. 30, 1996 (DE) ..... 196 43 861

(51) Int. Cl.[7] ..... B21D 53/52; A44B 1/04; B29C 0/00

(52) U.S. Cl. ..... 29/410; 264/229; 264/255; 24/387; 24/433; 29/458

(58) Field of Search ..... 264/229, 255; 24/389, 381, 384, 388, 433, 387, 436; 156/66; 427/172, 284, 412.1, 413; 29/458, 428, 527.1, 527.2, 527.3, 410, 408

(56) References Cited

U.S. PATENT DOCUMENTS

| | | | | |
|---|---|---|---|---|
| 2,557,827 A | | 6/1951 | Krupp | 24/205.1 |
| 2,800,699 A | * | 7/1957 | Armstong | 24/387 |
| 2,923,992 A | * | 2/1960 | Armstrong | 24/387 |
| 3,501,816 A | | 3/1970 | Heimberger | 24/205.1 |
| 3,591,914 A | | 7/1971 | Heimberger | 29/408 |
| 3,874,037 A | | 4/1975 | Takamatsu | 24/205.1 |
| 4,825,514 A | * | 5/1989 | Akeno | 24/387 |
| 4,842,799 A | | 6/1989 | Kusayama | 264/265 |
| 5,253,395 A | * | 10/1993 | Yano | 24/389 |
| 5,437,888 A | * | 8/1995 | Ortieb | 427/172 |

FOREIGN PATENT DOCUMENTS

| | | |
|---|---|---|
| DE | 4129191 | 3/1993 |

* cited by examiner

*Primary Examiner*—Jan H. Silbaugh
*Assistant Examiner*—Geoffrey P. Shipsides
(74) *Attorney, Agent, or Firm*—Darby & Darby

(57) ABSTRACT

A water-tight and gas-tight zip fastener with a sealing port and a method for forming the same provides a zip fastener made of plastic in which preferably spirals in a spiral zip fastener are injection molded with a thermoplastic elastomer which forms a continuously contoured coating, bearing directly on the contiguous edges of the zip fastener strips, and when the zip fastener is closed, the coatings are under compression and form a contiguous seal with each other and to the zip fastener slide to prevent undesirable gas and water penetration.

9 Claims, 3 Drawing Sheets

1
2
3
4
5
6
7
8
9
10
30

METHOD FOR THE PRODUCTION OF A WATERPROOF AND GASPROOF ZIP FASTENER

BACKGROUND TO THE PRESENT INVENTION

1. Field of the Invention

The invention relates to a water-tight and gas-tight zip fastener and a method for forming having a bridge, a transitional section, and a continuous bead. More particularly the invention relates to a water-tight and gas-tight zip fastener where a port includes sealing rings which seal in compression to a slide side core and between opposing legs.

2. Description of the Related Art

One method for forming a related zip fastener is known from DE-C-41 29 191. There, a closed spiral zip fastener is coated by means of an extrusion process and subjected to a cooling section, whereby a lateral tensile force is applied to the zip fastener strips. Then, the zip fastener is separated for later processing.

OBJECTS AND SUMMARY OF THE INVENTION

An objective of the present invention is to create an improved method of manufacturing a water-tight and gas-tight zip fastener in which such a zip fastener can be produced cost-effectively by simple means and with a complete seal.

It is another objective of the present invention to provide a water-tight and gas-tight zip fastener which provides a double seal in a port around a slide.

It is another objective of the present invention to provide a slide in the zip fastener which applies compression to a bridge portion of a port and reliably seals the slide to the port to eliminate fluid and gas seepage around the slide.

According to the present invention, a closed zip fastener, consisting of two zip fastener strips with spiral-shaped plastic zip fastener halves, is manufactured by means of an injection molding process.

The zip fastener of the present embodiment is injection molded in sections using an incremental feed to form a contoured profile on one side of a matched pair of zip fastener strips.

At least during the injection molding process, a lateral tensile force is applied to the zip fastener strips, which after the molding process is complete operate to provide a tensile force on each other and compress the coated sections together to seal out gas and moisture.

According to the present invention, the coating material consists of a thermoplastic polyurethane. The coating, prior to the first separation of the zip fastener strips, is formed at least on the top of the zip fastener strips, and is pre-slit in an opening direction. Frequently, there may be minimal or no lower coating on the underside of the zip fastener strips, but a lower coating may be applied to the underside of the zip fastener strips to provide additional leak resistance and sealing.

In the zip fastener, spiral zip fasteners may be preferably used, but are not necessarily used. The spirals can alternatively be elastically connected with the zip fastener strips, each being provided with a core that is elastically deformable in lateral direction, away from an opposite spiral row during formation of the coating sections.

Preferably a cut for the pre-slitting between the contoured coatings is made by means of a cam control on at least one end, with the cutting depth being adjustable to aid in accuracy during formation.

According to a special embodiment of the invention, in a second injection molding process, an additional coating material is placed in the slit and/or at least one additional parallel slit, and if necessary, the pre-slitting is repeated.

Prior to the injection-molding process, the zip fastener is available as bulk stock. After the contoured coating is applied by injection molding to the zip fastener, the zip fastener is cut to certain lengths, and in a second injection-molding process, a port is injection-molded.

The port is designed as a continuous bead surrounding a port hole. At least one sealing lip for a slide core of a slide is provided in the port hole of the port. Farther up on the port on at least a top surface, a sealing ring or another form of sealing lip may be preferably arranged. Advantageously, the bead is decorated inside the port hole on an underside portion so that while the zip fastener is in an open state the decorated area can be seen and the open state noticed by an observer for safety.

The port is also provided with a transitional section, which in the present embodiment widens into the shape of a wedge, extending in the continuous bead from the contoured coating to the port, so that the legs of the slide can exert a greater lateral pressure on the bridge and transition sections in a closed state and press the sealing lips and sealing rings against the slide and prevent gas and water leakage.

Before, during or after cutting to length, the end of the zip fastener, to which the port is to be injection molded, must be provided with a profile that improves the connection between the now contoured and coated zip faster and the to-be-formed port. An example of this type which provides and aids strong connection during injection molding is a notch, but other designs are allowable.

After forming the port, bridge, transitional section, and continuous bead one on end of the zip fastener, an end stop is injection molded onto the other end of the zip fastener to act as a stop for the slide during an opening process.

Prior to coating, the zip fastener strips are beneficially provided with a precoating or lamination, whereby the precoating or lamination may reach bonding values of at least about 180 N/5 cm thereby allowing a strong bond between the zip fastener strips and the contoured coating. As is known in the related art, a bonding value of up to 180 N/5 cm, means that a continuous force of at least 180N must be applied to tear asunder a 5 cm welding between two weldable textile materials. In the present circumstances, bonding forces of at least about this amount dictate effective bonding between the injection molded (weldable) coatings and the two weldable textile materials (zip fasteners).

Additionally, prior to further processing and after the precoating, the zip fastener strips are first roughened and/or provided with a bonding agent before coating with the final contoured coating material.

The above, and other objects, features and advantages of the present invention will become apparent from the following description read in conjunction with the accompanying drawings, in which like reference numerals designate the same elements.

Below, the invention is described in more detail by means of examples shown in the drawings as follows:

DESCRIPTION OF THE PREFERRED EMBODIMENTS

Figures 1, 2, 3, 4, 5:
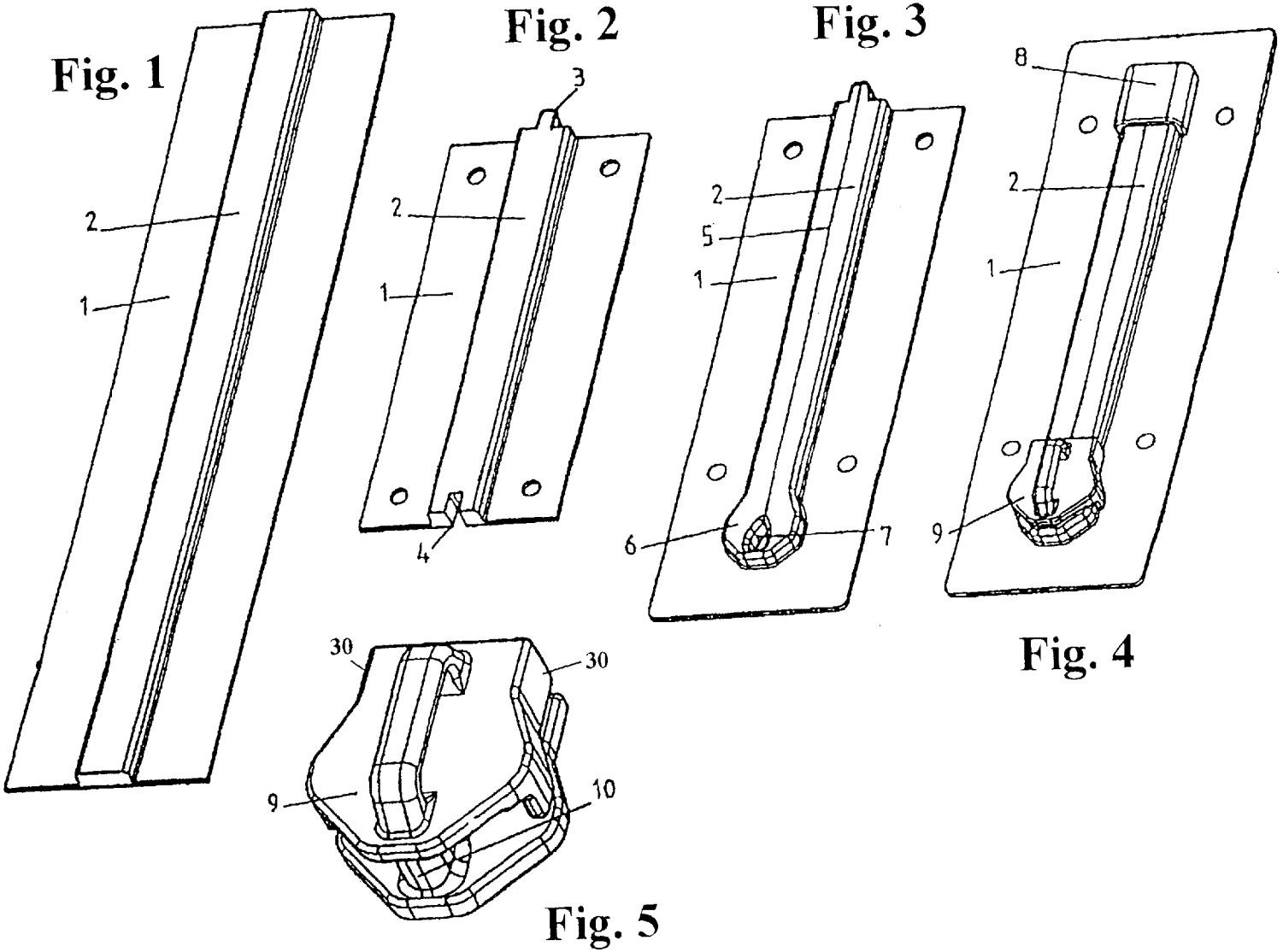
FIG. 1 shows a coated zip fastener section.
FIG. 2 shows a zip fastener section with connecting profiles.
FIG. 3 shows a zip fastener section with a injection-molded port.
FIG. 4 shows a finished zip fastener section.
FIG. 5 shows a zip fastener slide.

Referring now to FIG. 1, a zip fastener includes two zip fastener strips 1 in a closed position injection molded with a coating material 2. As shown, the coating material is formed into a contoured coating providing easy and sealable operation with a slide, as will be described. The contoured coating has a box-like structure and a smooth transition to the surface of the zip fastener strips to eliminate stress concentration points as a source of future leaks. Where the coating material 2 is applied to the bottom edges of the zip fastener strips 1, this coating material has a contour which is substantially level with the other sides of the respective zip fastener strips 1 so that the zipper will not catch on clothing or skin while in use.

Zip fastener strips 1 may be any effective zip fastener but are preferably spiral zip fastener strips.

Referring now to FIG. 2, zip fastener strips 1 are shortened to a preselected length, and a notch 4 and a process 3 have been formed on respective bottom and top edges of zip fastener 1. As noted above, notch 4 and process 3 allow for greater connection to port 6 and end stop 8 during later processing, as will be described.

Referring now to FIGS. 3 and 4, a port 6, having a port hole 7, is injection molded on the bottom end of zip fastener strips 1 and provide a continuous bead around the bottom end of zip fastener strips 1. A stop 8 is injection molded around the top end of zip fastener strips 1. A cut 5 separates the contoured coating 2 of respective zip fastener strips 1 and extends to port 6. Since coating 2 is applied to respective zip fastener strips 1 while the zip fastener strips 1 are both in a closed position and are under a slight tension with respect to each other, when the tension is released after the coating hardens, edges of cut 5 are pressed sealingly together when the zip fastener is closed. Since edges of cut 5 press together gas and moisture penetration are prevented.

Referring now to FIG. 5, a slide 9 includes a slide core 10, and a set of legs 30, 30 joining a top side and a bottom side together. As will be discussed later, internal dimensions between slide core 10, legs 30, 30 and the top and bottom side are sufficient to press port 6 together during use and seal port hole 7.

Figure 6:
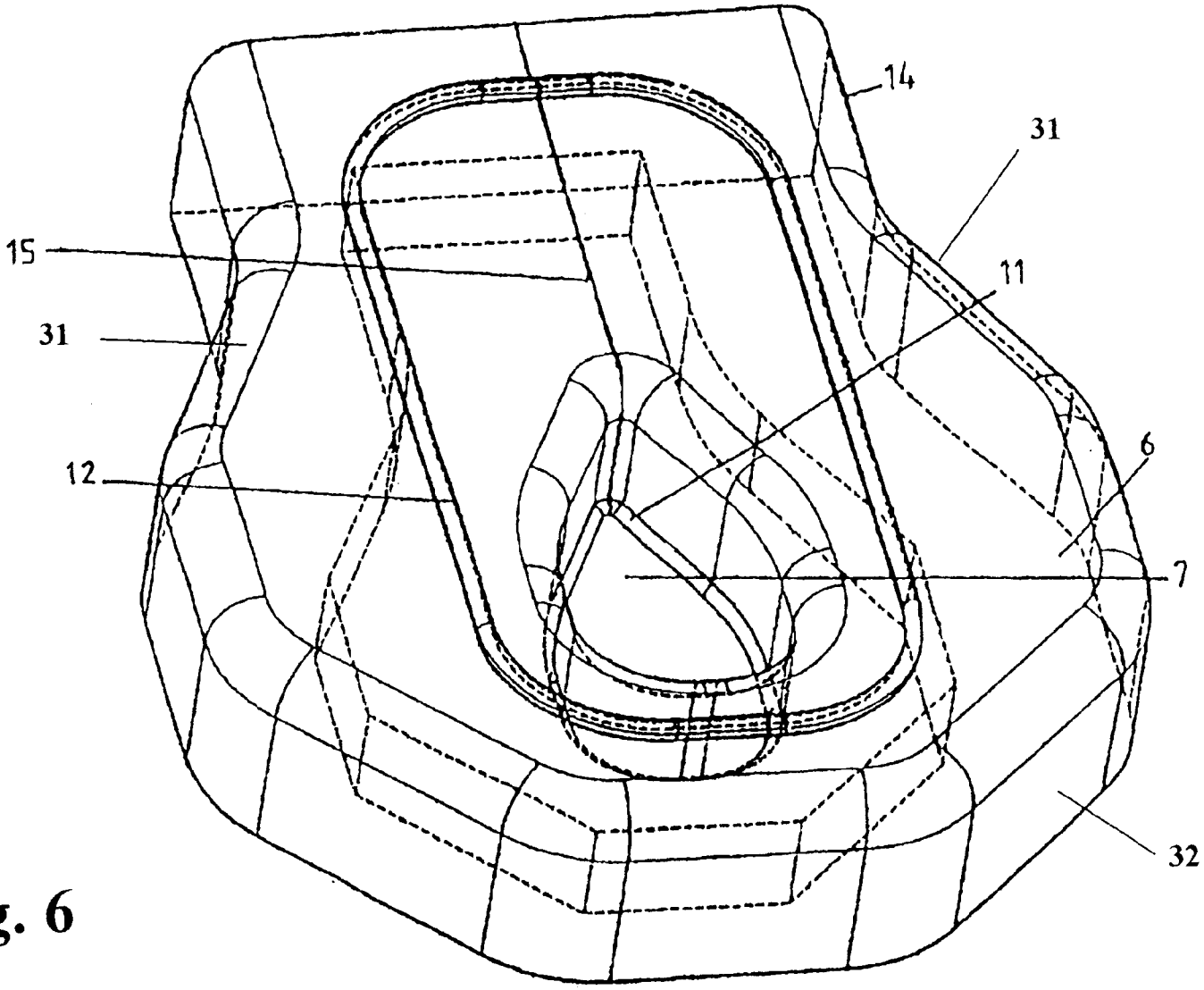
FIG. 6 shows a pictorial enlargement of the port from FIG. 3.
Figure 7:
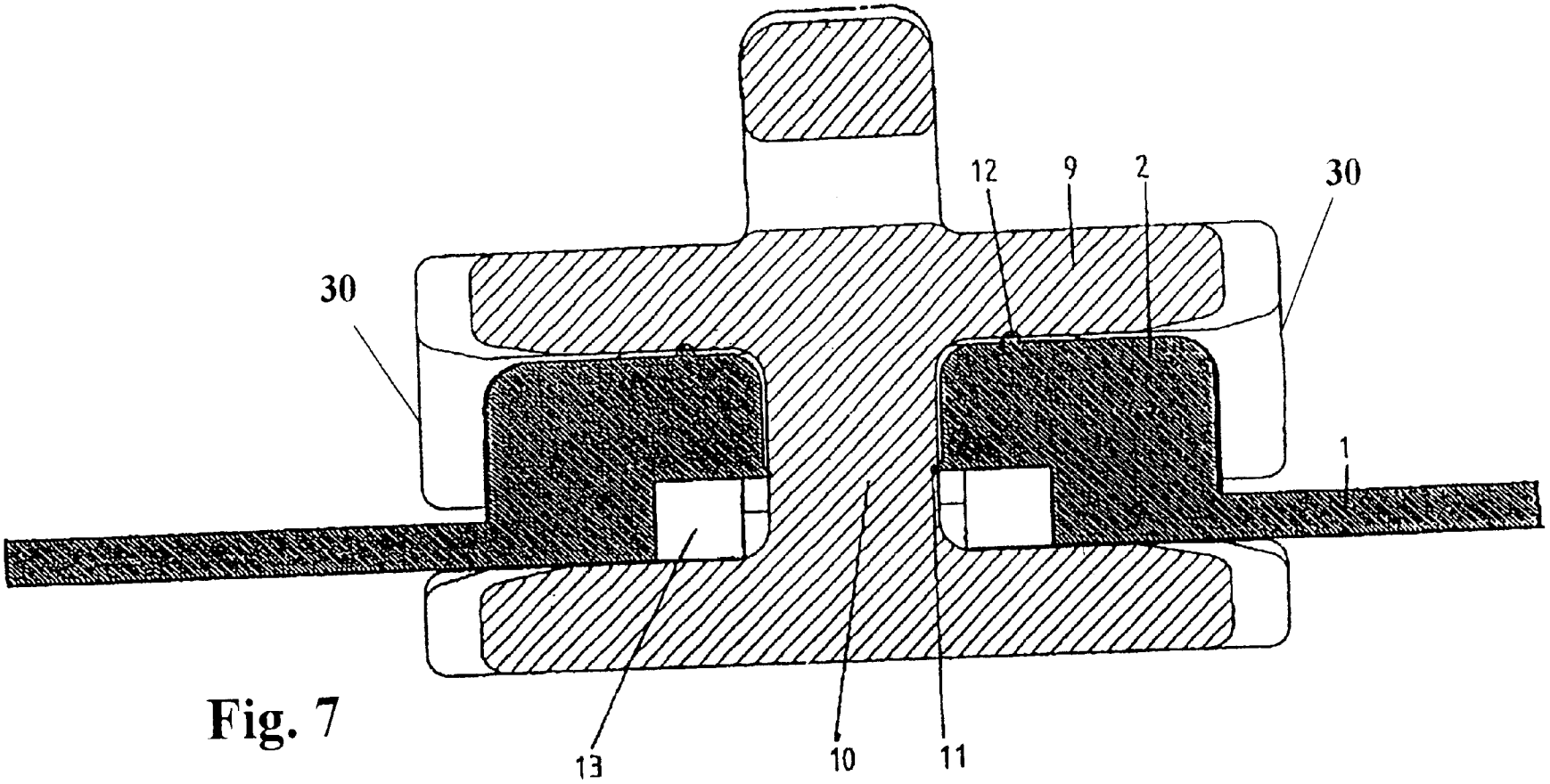
FIG. 7 shows a section through the port and the slide.

Referring now to FIGS. 6 and 7, port 6 continuously and sealingly joins coating 2 at a bridge 14. Cut 5 extends through bridge 14 in a partial section 15 to allow slide core 10 of slide 9 access to port 6. Bridge 14 is formed in a sightly over-dimensioned manner relative to the internal dimensions between slide core 10, legs 30, 30 and the top side and bottom side of slide 9. Consequently, when slide 9 is in a closed position (shown in FIGS. 4 and 7) in port 6, legs 30, 30 squeeze each side of cut 5 in bridge 14 together and form a strong barrier to gas and moisture.

A pair of transition sections 31, 31 continuously extend from bridge 14 in a continuous bead 32 which surrounds port hole 7. Together, coatings 2, bridge 14, transition sections 31, 31, and continuous bead 32 provide a continuous gas and water proof member around boat hole 7. Since coatings 2 and port 6 are injection molded to zip fastener strips 1, there is a continuous gas and water proof barrier around the zip fastener leaving only port hole 7 as a possible access point for undesirable gas and water.

A first continuous sealing lip 11 is formed during the injection molding process around an inner portion of port hole 7. A second continuous sealing lip 12 is formed during the injection molding process around a top portion of port hole 7. While slide 9 is in the closed position (see FIGS. 4 and 7), sealing lip 12 tightly contacts an underside of the top side of side 9 and provides a first barrier to gas and moisture penetration of port hole 7. Additionally, while slide 9 is in the closed position, sealing lip 11 tightly surrounds slide core 10 and provides a second barrier to gas and moisture penetration of port hole 7.

It should be readily understood, that the compression of legs 30, 30 on bridge 14 and transition sections 31 aid the sealing pressure between sealing lips 11, 12 and slide 9. This compressive force may be increased or decreased according to manufacturer design parameters.

It should be readily understood, that additional sealing lips may be formed on port 6 to prevent gas and moisture penetration of port hole 7.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the spirit and scope of this invention as defined in the following claims. In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies entirely on friction between a wooden part and a cylindrical surface, a screw's helical surface positively engages the wooden part, and a bolt's head and nut compress opposite sides of at least one wooden part, in the environment of fastening wooden parts, a nail, a screw, and a bolt may be readily understood by those skilled in the art as equivalent structures.

Having described preferred embodiments of the invention with reference to the accompanying drawings, it is to be understood that the invention is not limited to those precise embodiments, and that various changes and modifications may be affected therein by one skilled in the art without departing from the scope or spirit of the invention as defined in the appended claims.

What is claimed is:

1. A water-tight and gas-tight zip fastener having a first and a second row of teeth on first and second fastener strips, comprising:

a thermoplastic elastomer coating on at least a first side of each said first and said second fastener strips;

said thermoplastic elastomer coatings being at least a contoured coating on each said first and second rows of teeth;

each said contoured coatings having respective sealing shapes resiliently pressing together upon a closing of said zip fastener and preventing at least one of a water and a gas penetration of said zip fastener along said rows of teeth;

an end stop sealing together said first and second fastener strips at a top end;

a slide in said zip fastener;

said slide including at least a slide core and legs opposite said slide core;

a port on at least a bottom end of said zip fastener opposite said end stop;

said port sealingly joining said contoured coatings at a bridge portion from said first to said second fastener strips;

a port hole in said port having a shape effective to sealingly receive said slide core during said closing;

a transitional section in said port extending from said bridge portion and joining a continuous bead surrounding said port hole;

said transitional section having at least a wedge-shape;

said bridge being slightly over-dimensioned and said transitional section widening wedge-like, whereby said legs compress at least said transitional section and said bridge during said closing and prevent said water and said gas penetration of port in said zip fastener;

at least a first sealing lip in said port surrounding said port hole; and said first sealing lip providing sealing contact to said slide core upon said closing, whereby said first sealing lip contacts said slide core and prevents said water and said gas penetration of said port.

2. A zip fastener, according to claim 1, further comprising:

at least a second sealing lip on a top surface of said port;

said top surface proximate an underside of said upper member of said slide;

said second sealing lip surrounding said port hole; and said second sealing lip providing sealing contact between said port and said upper member of said slide upon said closing, whereby said second sealing lip elastically contacts said slide and prevents said water and said gas penetration of said port.

3. A zip fastener, according to claim 2, wherein:

said zip fastener is a spiral zip fastener.

4. A zip fastener, according to claim 3, wherein:

said spiral zip fastener includes a deformable core; and said deformable core being deformable perpendicular to said first and said second fastener strips.

5. A method for manufacturing a water-tight and gas-tight zip fastener having a first and a second row of teeth on first and second fastener strips, comprising the steps of:

injection molding a thermoplastic elastomer coating on at least a top side of each said first and said second rows of teeth while said teeth are in a closed position;

said step of injection molding including a step of tensioning said rows of teeth prior to application of said thermoplastic elastomer coating;

said step of injection molding including a step of forming said coating in at least a contoured coating on each said first and said second rows of teeth;

said step of forming said contoured coating including a step of forming said contoured coatings into a shape providing resilient contact between each respective said coating upon a closing of said zip fastener;

forming a port on a bottom end of said first and said second rows of teeth;

said step of forming a port including a step of forming a continuous bead surrounding a port hole in said port;

said step of forming a port including a step of forming a bridge and a transition portion joining each said first and said second rows of teeth with said continuous bead;

said step of forming said port including a step of forming at least a first sealing lip in said port hole;

forming a slit between respective contoured coatings;

injection molding an end stop at a top end of said first and said second rows of teeth;

said step of injection molding said end stop being effective to seal said top end of said first and said second rows of teeth;

selecting a slide having at least a first inner dimension smaller than an outer dimension of said bridge and said transition portion;

assembling said slide with said port and said coating, whereby a slide core in said slide contacts said at least first sealing lip in said port hole upon a closing of said zip fastener and said slide sealing compresses both said bridge and said transition portion upon said closing; and providing sealing contact to said slide core upon said closing, whereby at least a first sealing lip in said port surrounding said port hole contacts said slide core and prevents said water and said gas penetration of said port.

6. A method for manufacturing a zip fastener, according to claim 5, wherein:

said step of forming said port further includes a step of forming at least a second sealing lip on a top surface of said port; and said second sealing lip contacting a bottom surface of an upper member of said slid upon said closing.

7. A method for manufacturing a zip fastener, according to claim 6, wherein:

said step of injection molding a thermoplastic elastomer coating does not include a step of forming a coating on a bottom side of said first and said second rows of teeth.

8. A method for manufacturing a zip fastener, according to claim 7, wherein:

said step of forming a bridge and a transition section includes a step of forming said transition section in a wedge-shape.

9. A method for manufacturing a zip fastener, according to claim 5, further comprising the step of:

selecting a spiral zip fastener as each said first and said second fastener strips before said step of injection molding a thermoplastic elastomer coating; and said spiral zip fastener includes an elastically deformable core.

* * * * *